US005367710A

United States Patent [19]

Karmin

[11] Patent Number: 5,367,710

[45] Date of Patent: Nov. 29, 1994

[54] MEDICAL GOWN FOR PRESERVING PRIVACY

[76] Inventor: James L. Karmin, 1714 N. Burling, Chicago, Ill. 60614

[21] Appl. No.: 3,328

[22] Filed: Jan. 12, 1993

[51] Int. Cl.[5] ..... A41D 1/06; A41D 10/00; A41D 13/00

[52] U.S. Cl. ..... 2/114; 2/69; 2/79; 2/227

[58] Field of Search ..... 2/69, 69.5, 46, 48, 2/49 R, 50, 51, 52, 75, 79, 80, 83, 67, 114, 79, 227, 105, 106, 913, 914, 915; 450/86

[56] References Cited

U.S. PATENT DOCUMENTS

| | | | |
|---|---|---|---|
| 1,128,906 | 2/1915 | Schiff | 2/76 |
| 1,208,715 | 12/1916 | Bartrum | 2/79 |
| 1,789,007 | 1/1931 | Levy | 2/80 |
| 1,867,445 | 7/1932 | Dills | 2/67 |
| 2,015,589 | 9/1935 | Cahn | 2/80 |
| 2,132,466 | 10/1938 | Goldberg | 2/80 X |
| 2,436,610 | 2/1948 | Saxon | 2/80 |
| 2,535,018 | 12/1950 | Reid | 2/67 |
| 2,661,473 | 12/1953 | Miles | 1/1 |
| 2,735,102 | 2/1956 | Plaltner | 2/80 |
| 3,187,343 | 6/1965 | Sage | 2/80 |
| 3,465,754 | 9/1969 | Lockwood et al. | 450/86 |
| 3,490,072 | 1/1970 | Keltner | 2/114 |
| 4,370,757 | 2/1983 | Richmond . | |
| 4,543,668 | 10/1985 | Franklin . | |
| 4,570,268 | 2/1986 | Freeman | 2/114 |
| 4,612,673 | 9/1986 | Underhill . | |
| 4,620,326 | 11/1986 | Matthias, Jr. | 2/237 X |
| 4,622,699 | 11/1986 | Spriggs . | |
| 4,893,358 | 1/1990 | Bice, Jr. | 2/237 X |
| 5,062,159 | 11/1991 | Jakub . | |
| 5,084,914 | 2/1992 | Hesch . | |
| 5,088,117 | 2/1992 | Fulmer . | |
| 5,093,932 | 3/1992 | Doyle . | |
| 5,097,536 | 3/1992 | Cohen . | |
| 5,133,086 | 7/1992 | Truitt . | |
| 5,150,477 | 9/1992 | Elberson et al. . | |
| 5,157,789 | 10/1992 | Klass . | |

*Primary Examiner*—Jeanette E. Chapman
*Attorney, Agent, or Firm*—Marshall, O'Toole, Gerstein, Murray & Borun

[57] ABSTRACT

An examination gown comprises a pants member with an integrally attached bib. The bib includes a top edge with left and right sides, a right edge and a left edge. A right side strap member has a first end attached to a right side top edge and has a second end attached to a right edge. A left side strap member has a first end attached to a left side top edge and has a second end attached to a left edge. The back side of the pants member includes a drawstring along the upper edge of the back side.

16 Claims, 5 Drawing Sheets

MEDICAL GOWN FOR PRESERVING PRIVACY

BACKGROUND OF THE INVENTION a. Field of the Invention

The present invention relates to the field of medical gowns. More particularly, the present invention relates to a medical gown that preserves a patient's privacy while allowing access to selected portions of the patient for examination and/or treatment.

b. Background

When a patient visits a chiropractor, osteopath, physician, or physical therapist, the patient is often required to disrobe, at least partially to accommodate an examination and/or a treatment. Many disrobed patients are provided with a hospital or examination gown (hereinafter "examination gown"). However, from the patient's perspective, the need to don the conventional examination gown makes for an uncomfortable experience.

One problem with the conventional examination gown is that it was designed to allow access to the most commonly examined portions of the patient's body. However, the conventional examination gown covers the patient's shoulders, neck and upper back. To examine or treat these latter areas, the conventional examination gown must be unfastened behind the patient's neck and pulled forward or completely removed. It is an object of the present invention to provide an examination gown that facilitates the treatment and/or examination of the patient's neck, back and spine. It is a further object of the present invention to provide an examination gown that would be useful to a chiropractor, osteopath, physician or physical therapist during the examination and/or treatment of a patient's neck, back and/or spine.

Because such treatments may be monitored by x-ray, it is an object of the present invention that the examination gown by x-ray compatible. To accommodate the examination and treatment of both males and females, it is also an object of the present invention that the examination gown be designed to individually accommodate both a woman and a man, i.e., to be "unisex."

Another problem with the conventional examination gown is that it is awkward to put on. The conventional examination gown resembles a short sleeve shirt or blouse that is put on backwards. Unlike a shirt or blouse, the conventional examination gown is secured by a single snap or tie behind the patient's neck. Many elderly or disabled patients are unable to reach behind their necks to snap or tie their gown. Others, particularly those suffering from back pain, find it difficult to reach behind their necks with both arms to snap or tie their examination gown. Accordingly, it is an object of the present invention to provide an examination gown that does not require the wearer to place both hands behind the neck to achieve closure.

An additional problem with the conventional examination gown is that it remains open from the top closure along the entire length of the patient's backside. As a result, the gown reveals the patient's lower posterior anatomy as the patient stands or moves about. A particularly embarrassing situation arises when the patient must lay face down on an examination or treatment table, i.e., the side panels of the conventional examination gown fall to the patient's side, completely exposing the patient's lower backside anatomy, i.e., buttocks. Most patients consider their lower backside anatomy to be private and feel uncomfortable when it is exposed, particularly when it is not the subject of the examination or treatment. As a result, many patients choose not to remove their lower underwear when donning the conventional examination gown. Even when wearing their lower underwear, many of these patients, particularly women, still feel tense. In contrast, most medical examinations and treatments yield better results when the patient is relaxed. This is especially true of treatments, such as manipulations, that are administered by a chiropractor or an osteopath. Accordingly, it is an object of the present invention to provide a medical examination gown that preserves a patient's privacy, that allows a patient to feel comfortable about one's self, and that facilitates treatment by reducing the tension that a patient feels.

The practice of requiring a patient to wear a conventional examination gown can also be detrimental to the patient's relationship with his doctor. The loss of dignity that a patient feels wearing a conventional examination gown can ultimately build up to resentment. Patient compliance has always been a problem. However, certain types of treatments, such as manipulations, cancer treatments, and physical therapy, require that the patient voluntarily attend a proscribed series of sessions. The patient's willingness to attend all the sessions may be facilitated if the patient is provided with an examination gown that protects the patient's sense of dignity.

Thus, it is an object of the present invention to provide a gown for examination and/or treatment of a patient that protects a patient's dignity. It is a further object of the present invention that the gown cover the patient's private areas during examination and/or treatment. It is yet another object of the present invention that the gown allow a chiropractor, osteopath, physician, or physical therapist to have proper access to the non-private areas of a patient's body for examination and/or treatment.

One attempt to produce an examination gown that preserves a patient's dignity is disclosed in U.S. Pat. No. 4,370,757 (Richmond), which issued on Feb. 1, 1983. In Richmond, the examination garment resembles a pair of chaps, such as worn by cowboys, which is open in the back and ties behind the waist. According to Richmond, modesty protection is provided by a foldable modesty panel which extends downward from the crotch area to cover the patient's genitalia. However, Richmond's gown suffers from the same problem as the conventional hospital gown, i.e., the patient's lower posterior (i.e., rump) area remains exposed. It is an object of the present invention to provide an examination gown that not only covers a patient's genitalia, but also the patient's rump area as well. It is also an object of the present invention to provide an examination gown that does not require tying behind the waist.

Another attempt to produce an examination gown that protects a patient's sense of dignity is disclosed in U.S. Pat. No. 5,093,932 (Doyle) which issued on Mar. 10, 1992. Doyle's examination garment resembles a unisex "jump suit or coveralls" ['932 at col. 2, ln. 56] having a "crotch slit" [col. 2, ln. 47] and "[e]xcess fabric surround[ing] the crotch slit" [col. 2, at ln. 51]. The crotch slit, while covering the genitalia, provides an access to the genitalia that may be uncomfortable to some patients. Accordingly, it is an object of the present invention to provide an examination gown that provides access to all areas of a patient's body except the patient's private areas.

SUMMARY OF THE INVENTION

The present invention is directed to an examination gown for a human patient that preserves the patient's privacy. The examination gown of the present invention has multiple uses. In a particularly preferred use, the examination gown of the present invention allows a chiropractor, an osteopath, a physician or a physical therapist to examine and/or treat a patient's neck, back and/or spine while maintaining the patient's sense of dignity.

In particular, the present invention is directed to an examination gown for a human patient comprising:

a pants member capable of being pulled up to a patient's waist, the pants member having a front side and a back side, the front side of the pants member having a bib integrally attached thereto, the bib having a top edge, a right side edge, and a left side edge, the top edge of the bib having a right side and a left side;

a right side strap member having a first end and a second end, the first end of the right side strap member being affixed to the right side of the top edge of the bib, the second end of the right side strap member being affixed to the right side edge of the bib, the right side strap member and the bib edge(s) between the first and second ends of the right side strap member forming a loop that is capable of receiving the right arm and being pulled up to and over the right shoulder of a patient wearing the pants member; and a left side strap member having a first and a second end, the first end of the left side strap member being affixed to the left side of the top edge of the bib, the second end of the left side strap member being affixed to the left side edge of the bib, the left side strap member and the bib edge(s) between the first and second ends of the left side strap member forming a loop that is capable of receiving the left arm and being pulled up to and over the left shoulder of a patient wearing the pants member;

the right side and left side strap members, when pulled over a patient's right and left shoulders respectively, are capable of raising the bib to substantially cover a patient's chest;

the pants member also having a means for gathering and securing the examination gown about a patient's waist, such that even if the right side and left side strap members are not over the patient's shoulders, the pants member is capable of being secured about the patient's waist to cover the patient's buttocks and genitalia.

DETAILED DESCRIPTION OF THE INVENTION

Figure 1:
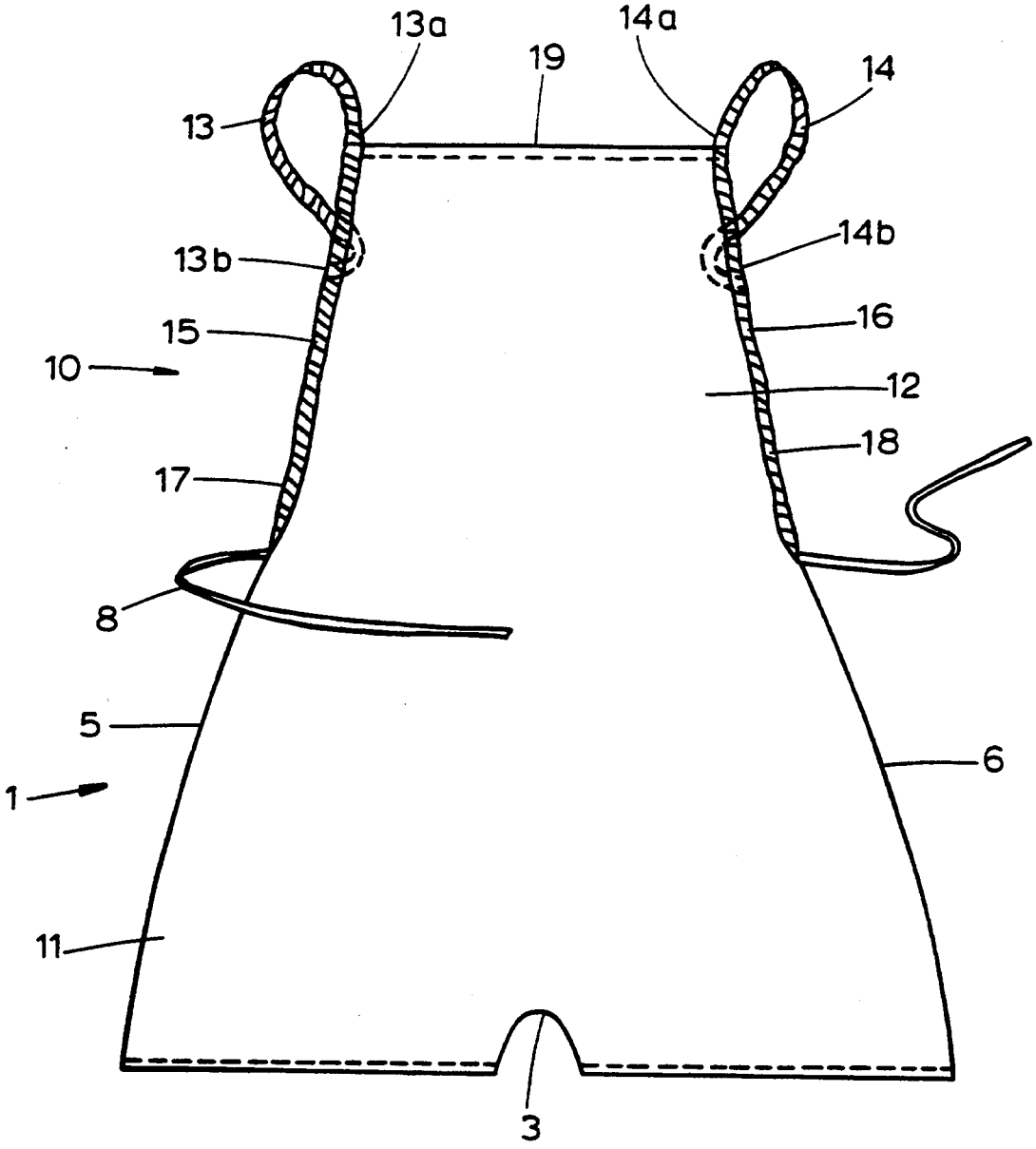
FIG. 1 is a frontal view of one embodiment of the examination gown of the present invention.

The present invention encompasses an examination gown for a human patient that is capable of preserving the patient's privacy. More particularly, the present invention is directed to an examination gown comprising:

a pants member capable of being pulled up to a patient's waist, the pants member having a front side and a back side, the front side of the pants member having a bib integrally attached thereto, the bib having a top edge, a right side edge, and a left side edge, the top edge of the bib having a right side and a left side;

a right side strap member having a first end and a second end, the first end of the right side strap member being affixed to the right side of the top edge of the bib, the second end of the right side strap member being affixed to the right side edge of the bib, the right side strap member and the bib edge(s) between the first and second ends of the right side strap member forming a loop that is capable of receiving the right arm and being pulled up to and over the right shoulder of a patient wearing the pants member; and a left side strap member having a first and a second end, the first end of the left side strap member being affixed to the left side of the top edge of the bib, the second end of the left side strap member being affixed to the left side edge of the bib, the left side strap member and the bib edge(s) between the first and second ends of the left side strap member forming a loop that is capable of receiving the left arm and being pulled up to and over the left shoulder of a patient wearing the pants member;

the right side and left side strap members, when pulled over a patient's right and left shoulders respectively, are capable of raising the bib to substantially cover a patient's chest;

the pants member also having a means for gathering and securing the examination gown about a patient's waist, such that even if the right side and left side strap members are not over the patient's shoulders, the pants member is capable of being secured about the patient's waist to cover the patient's buttocks and genitalia.

The pants member of the examination gown may be long legged or short legged. However, in order for a single garment to accommodate the greatest size variation among patients, the pants member is preferably short legged. More preferably, the short legged pants member is about knee length on an average patient standing about 5 feet 9 inches tall. It is also within the scope of the present invention to provide more than one size of the examination gown to accommodate the extreme size range between human patients.

In the examination gown of the present invention, the pants member has four sides: a front side, a back side, a right side and a left side. The front side of the examination gown has a bib integrally attached thereto. By the phrase "integrally attached" is meant that the bib and the front sides of the pants member may be formed from a single piece of material or that the bib may be a separate unit that has been affixed to the pants member at or about the top front edge of the pants member.

There are various methods for affixing the bib to the front of the pants member. Typically, affixing is accomplished by sewing or gluing. Alternatively, when the material used to fabricate both the pants member and bib are synthetic, the bib and pants member are also capable of being affixed to one another by heat sealing or ultrasonic welding. Both heat sealing and ultrasonic welding are well known to those in the art.

The pants member is also capable of several embodiments. In one embodiment, a front pants panel is affixed to a correspondingly shaped rear pants panel, via a right pants seam, a left pants seam and a crotch seam. In another embodiment, the front and rear pants panel are fabricated as a single sheet of material that when folded over, provides overlapping front and rear panels of the same shape. The pants member is formed by effecting a crotch seam and an edge seam on the side opposite the fold.

The examination gown of the present invention also includes a right side strap member and a left side strap member. The strap members may be of the same or a different material as used in the bib and pants member of the examination gown. Preferably, the right side strap member and the left side strap member include a resilient material. By way of example, suitable resilient materials include straps or bands of elastic or rubber. For aesthetic purposes, the resilient bands are preferably enclosed in the same material that is used to form the bib and/or pants member of the examination gown of the present invention. Typically, a strip of material, such as used to fabricate the bib, is folded over to encase the resilient band. A straight running stitch is then sewn along one side. The resulting stitched strip of material for encasing the resilient band therein is known as a "casing" in the sewing art. If the resilient band is stretched while in the casing and then sewn over, the resilient band would contract the casing upon release of the tension in the band to provide another embodiment of a resilient strap member that is capable of stretching to accommodate various body sizes and shapes.

Regardless of their composition or how they are constructed, each strap member of the present invention has a first end and a second end for fastening to the bib member.

The bib member of the examination gown may be of any shape that is capable of covering the patient's chest. For example, it may be square, rectangular, oval shaped, trapezoidal, and the like. Regardless of the shape of the bib, the first end of each strap member would be affixed along an upper edge (i.e., a "top edge") of the bib whereas the second end of each strap member would be affixed at a point along the corresponding side edge of the bib that is lower than the point of affixation of the first end. Thus, if the strap member is a right side strap member, its first end is along the right side of the top edge of the bib and its second end is affixed to the right edge of the bib at a point lower than the point of affixation of the first end. Preferably, the second end of the strap member is affixed along the respective side edge of the bib at a point that is from about 20% to about 70% of the distance between the point of attachment of the first end and the waist line of the pants member. More preferably, the second end of the strap member is affixed along the respective side edge of the bib at a point that is about one half of the distance between the point of attachment of the first end and the waist line of the pants member.

In the present invention, the function of the strap members is two-fold. Its first function is to raise the bib, via the first end of the right and left strap members. Its second function is to retain the right and left side of the bib substantially against the chest of a patient via the second end of the strap member. Preferably, the side edges of the bib member are hemmed to form a casing containing a second resilient band therein. The second resilient band may run the entire length of the casing or it may run only part of the length of the casing. Preferably, the second resilient band runs the entire length of the casing. More preferably, the second resilient band is contiguous with the first resilient band of the strap member. Suitable materials for the second resilient band are the same as those described above for the first resilient band.

The pants member of the examination gown of the present invention also has a means for gathering and securing the examination gown about a patient's waist (hereinafter "gathering and securing means"). The gathering and securing means allows the examination gown of the present invention to be used for patients of various sizes, particularly, patients of various waist sizes. A function of the means for gathering and securing the examination gown is to provide the patient with a sense of privacy even if the right side and left side shoulder straps are not over the patient's shoulders such that the bib is down and the patient's chest is exposed. Under these latter circumstances, the patient's most intimate privacy is maintained because the patient's buttocks and genitalia remain covered.

Thus, even when the bib is in the down position, the examination gown of the present invention is capable of providing a sense of privacy to patients undergoing cardiac and pulmonary studies where access to the patient's chest is necessary. Further, the examination gown of the present invention is also useful for female patients undergoing mammography studies wherein a patient is required to place an exposed breast directly against an X-ray film.

The means for gathering and securing the examination gown about a patient's waist may take several forms. It may consist of a drawstring arrangement, a pair of opposing strings or strips for tying, a hook and loop fastening system such as sold under the name Velcro®, or even a button and buttonhole arrangement.

The type of drawstring that is used in the examination gown of the present invention would depend in part upon whether the examination gown was intended to be sterilizable, washable, or merely disposable. For a sterilizable examination gown, the drawstring would be required to endure high temperatures or exposure to ethylene oxide (a sterilizing agent). A suitable material is cotton, preshrunk cotton or a cotton blend, preferably a cotton/polyester blend (hereinafter, collectively "cotton") material such as nylon that would be manufactured into a string. In form, the drawstring could be an actual string, or a strip fabricated from the above-mentioned materials. For disposable gowns, the drawstring may be fabricated from the described materials, but preferably, from less expensive materials.

Typically, the material that is used to fabricate the drawstring is the same material that is used to fabricate the pants member and bib of the examination gown. In this embodiment, an examination gown of the present invention that is fabricated from cotton would have a drawstring that is also fabricated from cotton, (e.g., cloth or string).

When the gathering and securing means is a drawstring, it is threaded through a casing that runs along the upper edge of the backside of the pants member such that the opposite ends of the drawstring exit the casing of the rear pants panel at right and left sides of the pants member. Preferably, the opposite ends of the drawstring exit adjacent the opposing bib edges. In this embodiment, the opposite ends of the drawstring hang down along the right sides and left sides respectively of the examination gown when the drawstring is in the untied position. In order to effect closure, a patient wearing the examination gown need only drop their hands to their sides, pick up the opposite ends of the drawstring and tie a typical bow knot in the front. In tying the bow knot, the patient would be both gathering any loose material and securing the pants member about the patient's waist. To preclude the drawstring from being pulled out of the casing of the pants member, the drawstring is optionally affixed within that casing at one or more points. A typical means of affixing the drawstring within the casing would be to stitch through the drawstring and the casing.

In another embodiment, a first and second strip of elongated cloth are sewn on the right and left sides respectively of the pants member at about the waist line. The two strips of cloth hang down on the right and left sides respectively of the examination gown. To gather and secure the examination gown about the waist, a patient places their hands to their side, grasps the two elongated pieces of cloth, pulls them in front of themselves, and ties a typical bow knot, such as one would use to tie a shoe.

In yet another embodiment of the present invention, the two elongated strips of cloth could have a tab of Velcro® on each end. Gathering and securing is accomplished by pulling the strips of cloth across the front of the patient's body in opposite directions, and then affixing the Velcro® ends to the opposing Velcro® receptor or to the examination gown itself if Velcro® hooks are used on the tabs. It is also within the scope of this invention to use only one of the above described strips with Velcro® thereon as the gathering and securing means. In this embodiment, the patient would gather the excess material in front and affix the end of the strip to the opposite side of the pants member at or about the waist.

In yet another embodiment, one of the elongated pieces of cloth could have a button, or a series of one or more buttons sewn thereon whereas the opposite piece of elongated cloth would have a series of one or more buttonholes placed within it. In order to achieve gathering a closure, a patient pulls the two pieces of cloth toward one another, and once the desired degree of tightness is attained, the patient would button one of the buttons in a buttonhole overlapping it. Because the above described gathering means are X-ray compatible, a patient wearing the hospital gown of the present invention is capable of having X-rays taken without the need to remove the examination gown.

Regardless of the embodiment, the examination gown of the present invention is capable of maintaining the privacy of both female and male patients.

It is within the scope of the present invention that the examination gown be sterilizable, washable, disposable and/or recyclable. Materials for fabricating examination gowns are already well known in the art. For example, a sterilizable examination gown is capable of being fabricated from a woven material such as cotton or cotton blended with synthetics (e.g., polyester, polypropylene, nylon and the like). Likewise, a washable examination gown of the present invention is also capable of being fabricated from the above described materials. In addition, washable hospital gowns may be fabricated from a number of synthetic woven materials, including rayon, orlon, rainey cotton, polyester, nylon, polypropylene, and the like and combinations thereof.

The examination gown of the present invention could be made to be disposable using any of the above described materials. However, to be cost effective, a disposable examination gown is preferably fabricated from paper or from a paper/synthetic film or paper/synthetic fiber laminate.

To be recyclable, the examination gown of the present invention is preferably made from paper. To the extent that adhesives are used in fabricating a recyclable examination gown, they are water soluble or water dispersible. Water soluble and water dispersible adhesives are well known in the art.

FIGS. 1 through 5 provides various embodiments of the examination gown of the present invention. FIG. 1 provides a frontal view of one embodiment of an examination gown 10 of the present invention. The examination gown 10 comprises a pants member 1 having a front pants panel 11 that is integrally connected to a bib member 12. The pants member 11 has a right side seam 5, left side seam 6, and a crotch seam 3. The bib member 12 has a right side edge 15, a left side edge 16 and a top edge 19. The right side edge 15 is associated with a right side edge casing 17, whereas the left side edge 16 is associated with a left side edge casing 18. The examination gown 10 has a right side strap member 13 and a left side strap member 14. The right side strap member 13 has a first end **13*a* that is contiguous with the right side edge casing 17. The left side strap member 14 has a first end 14*a* that is contiguous with the left side edge casing 18. The right side strap member 13 also has a second end (not shown) that is attached to the back (not shown) of the right side edge 15. Similarly, the left side strap member 14 has a second end (not shown) that is attached to the back (not shown) of the left side edge 16. The embodiment of FIG. 1 is also associated with the drawstring 8 for gathering and securing the pants member 11 of the examination gown 10 about the waist of a patient. The drawstring 8** is capable of being tied in a typical bow knot to effect the gathering and securing of the pants member.

Figure 2:
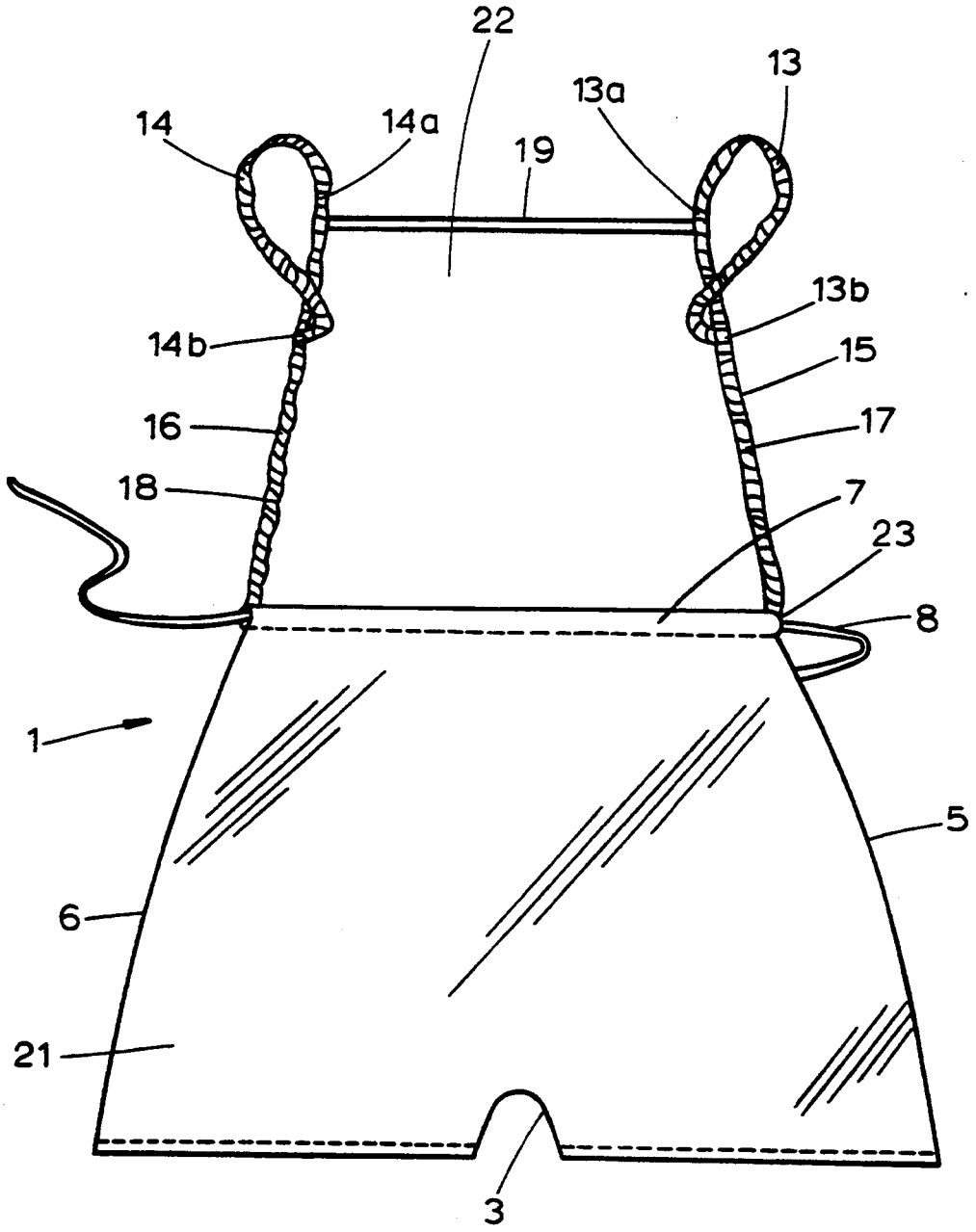
FIG. 2 is a rear view of the examination gown of FIG. 1.

FIG. 2 is the rear view of the examination gown of FIG. 1. The pants member 1 has a rear pants panel 21 that is connected to a front pants panel (not shown) via a right seam 5, a left seam 6, and a crotch seam 3. The top of rear pants panel 21 has a casing 7 through which a drawstring 8 is threaded. The bib panel 22, which is attached to the front pants panel (not shown), is associated with a right side edge 15 and a left edge side 16. The right side edge 15 is associated with the right side edge casing 17 and the left side edge 16 is associated with a left side edge casing 18. The right side strap member 13 has a first end **13*a* and a second end 13*b*. The first end 13*a* is contiguous with the right side edge casing 17. The second end 13*b* is attached to the right side edge casing 17 at a point that is between the point of attachment of the first end 13*a* and the waist line 23** of the pants member.

Figure 3:
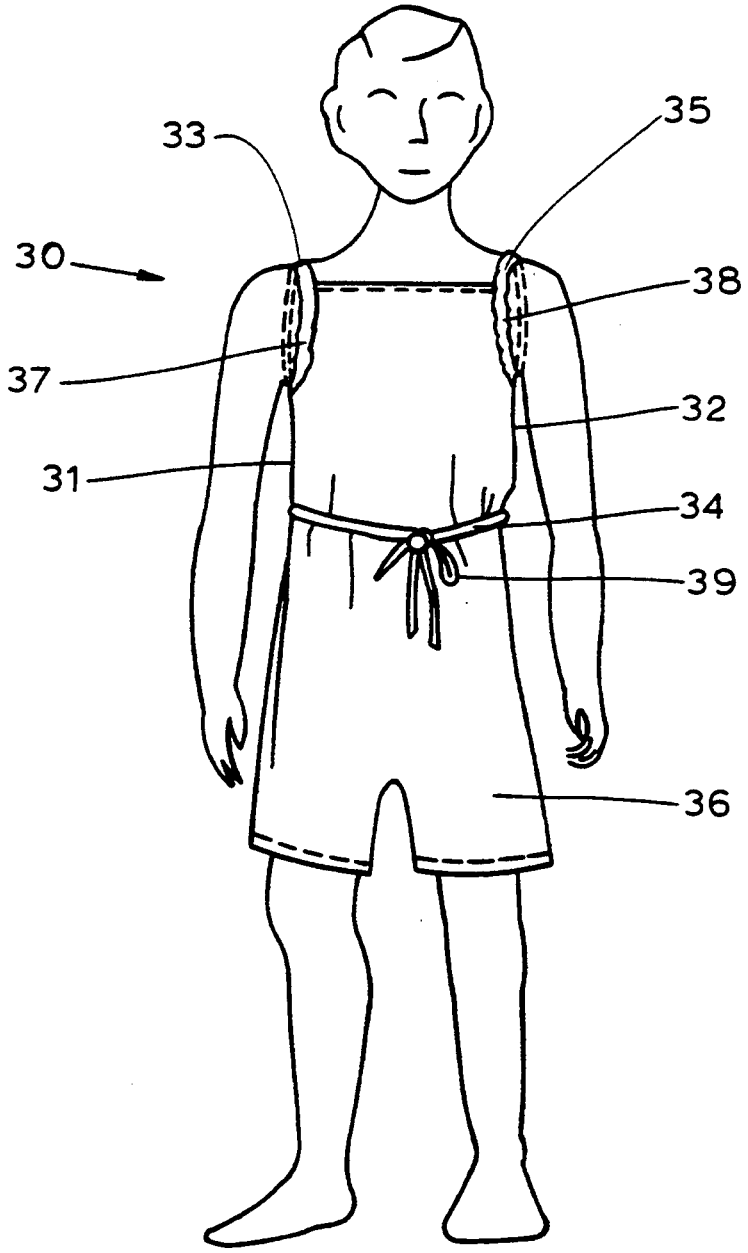
FIG. 3 is a frontal view of a patient wearing a second embodiment of the examination gown of the present invention.

FIG. 3 is a front view of a patient wearing a second embodiment of the examination gown of the present invention. In this embodiment, a right side strap member 33 is contiguous with a right side edge casing 37 and a left side strap member 35 is contiguous with a left side edge casing 38. Unlike the embodiment in FIG. 1, the right side edge casing 37 and the left side edge casing 38 only run about half the distance of the side edges 31 and 32 respectively. Also, in FIG. 3, a pair of cloth strips 34 are tied in front of the patient in a typical bow 39, thereby gathering and securing the pants member 36 about the waist of the patient.

Figure 4:
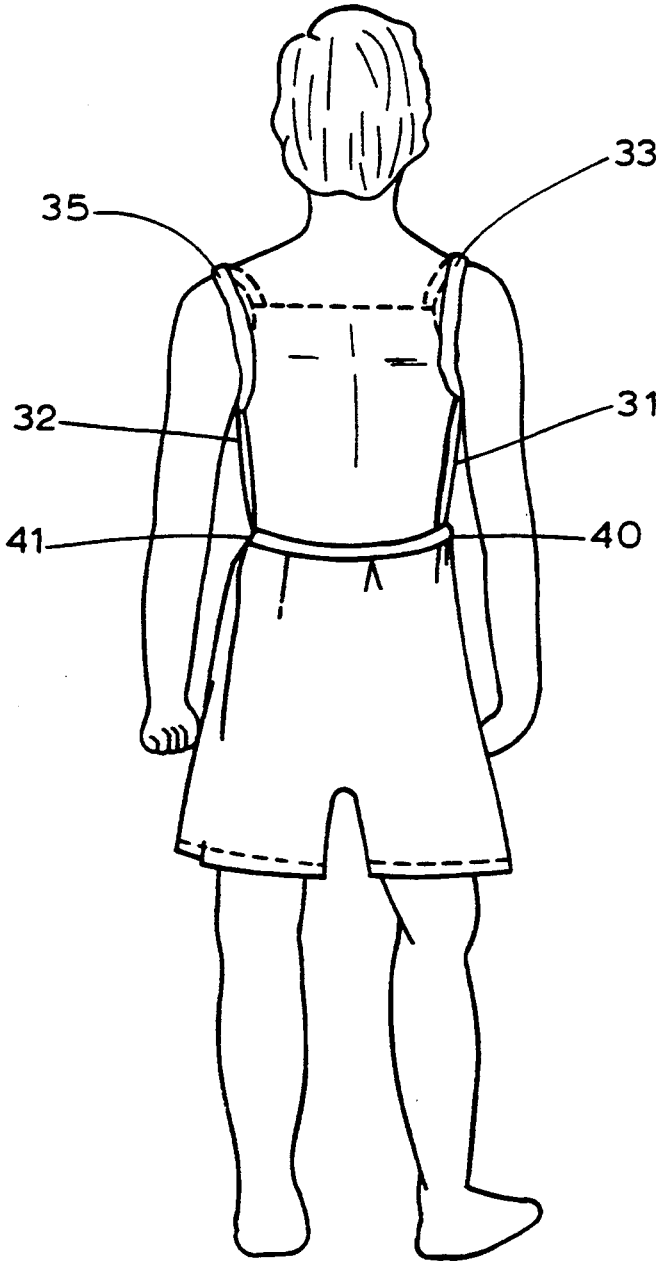
FIG. 4 is a rear view of a patient wearing the examination gown embodied in FIG. 3.

FIG. 4 is a rear view of the patient wearing the examination gown embodied in FIG. 3. Because the right side strap member 33 is over the right shoulder of the patient, and the left side strap member 35 is over the left shoulder of the patient, the patient's neck, back and spine are exposed for treatment or examination by a chiropractor, osteopath, physician or by a physical therapist. The right side edge 31 and the left side edge 32 of the bib are held substantially against the chest or upper torso of the patient. Points 40 and 41, which are along the waist of the pants member, are the respective points of attachment for the pair of cloth strips 34, which are not visible in FIG. 4, but which are shown in FIG. 3.

Figure 5:
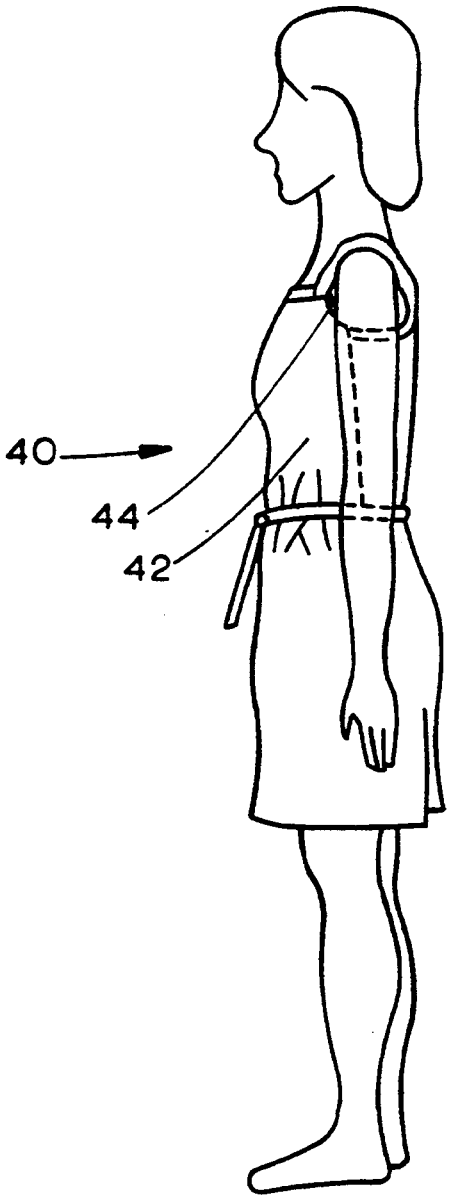
FIG. 5 is a side view of a patient wearing a third embodiment of the examination gown of the present invention.

FIG. 5 is a side view of a female patient wearing yet another embodiment of the examination gown of the present invention. In the examination gown 40 of FIG. 5 the bib 42 has a left side edge 44 that lacks a casing. This embodiment also shows that the neck, back and spine of the patient are exposed for examination and/or treatment by a chiropractor, osteopath, physician or a physical therapist. In contrast, the patient's private areas below the waist are covered, as well as the patient's chest area. The examination gown of the present invention thus allows a patient to relax by protecting or covering their private areas, while exposing those areas for treatment or examination by the above described medical practitioners. Because the patient is not made to feel uncomfortable, the patient is capable of relaxing and allowing the appropriate medical personnel to examine and/or treat their neck, back or spinal column.

What is claimed is:

1. An examination gown for a human patient comprising:

a pants member capable of being pulled up to a patient's waist, said pants member having a front side and a back side, the front side of said pants member having a bib integrally attached thereto, said bib having a top edge, a right edge and a left edge, the top edge of the bib having a right side and a left side;

a right side strap member having a first end and a second end, the first end of the right side strap member being affixed to the right side of the top edge of said bib, the second end of the right side strap member being affixed to the right edge of said bib, the right side strap member and the bib edge(s) between the first and second ends of the right side strap member forming a loop that is capable of receiving the right arm and shoulder of a patient; and a left side strap member having a first end and a second end, the first end of the left side strap member being affixed to the left side of the top edge of said bib, the second end of the left side strap member being affixed to the left edge of said bib, the left side strap member and the bib edge(s) between the first and second ends of the left side strap member forming a second loop that is capable of receiving the left arm and shoulder of a patient;

said right side and left side strap members, when pulled over a patient's right and left shoulders respectively, are capable of raising said bib to substantially cover the patient's chest;

said pants member also having a means for gathering and securing the examination gown about the patient's waist, such that even if the right side and left side strap members are not over the patient's shoulders, the pants member is capable of being secured about the patient's waist;

said means for securing comprises a drawstring having opposite ends that are threaded through a casing running along the upper edge of the back panel of said pants member, said drawstring having opposite ends that exit said casing at a right and a left side of the pants member, the opposite ends of said drawstring hanging down on a left and right side respectively of the examination gown when the drawstring is untied;

said examination gown being x-ray compatible, and when worn by a patient, is capable of maintaining the patient's privacy while allowing unobstructed access to the patient's back, neck, and spine.

2. The examination gown of claim 1 wherein both said pants member is short legged.

3. The examination gown of claim 1 wherein both said right strap member and said left strap member are resilient.

4. The examination gown of claim 3 wherein said right strap member and said left strap member are each hemmed and each strap member has a first resilient band enclosed respectively therein.

5. The examination gown of claim 4 wherein the right edge and the left edge of said bib are hemmed to form a right edge casing and a left edge casing respectively, each of said edge casings having a second resilient band enclosed therein, said second resilient bands being capable of drawing the bib edges substantially against the body of the patient.

6. The examination gown of claim 5 wherein the right edge casing and the left edge casing each have a resilient band therein that runs the entire length of the casing.

7. The examination gown of claim 5 wherein first and second resilient bands on each side of the examination gown are contiguous.

8. The examination gown of claim 5 wherein the pants member is approximately knee length.

9. The examination gown of claim 8 wherein said means for securing the gown about the patient's waist is X-ray compatible.

10. The method of claim 1 wherein the drawstring is a member of the group consisting of a rope and a sash.

11. The examination gown of claim 5 wherein the right edge casing and the left edge casing each have a resilient band running less than the full length of the casing.

12. The examination gown of claim 9 comprised of a disposable material.

13. The examination gown of claim 9 comprised of a sterilizable material.

14. The examination gown of claim 13 wherein said sterilizable material is cotton.

15. The examination gown of claim 12 wherein the disposable material is a member of the group consisting of paper, paper/synthetic film laminates, and paper/-synthetic fiber laminates.

16. The examination gown of claim 14 wherein the front panel of said pants member and said bib are of unitary construction.

* * * * *

UNITED STATES PATENT AND TRADEMARK OFFICE

CERTIFICATE OF CORRECTION

PATENT NO. : 5,367,710

DATED : November 29, 1994

INVENTOR(S) : JAMES I. KARMIN

It is certified that error appears in the above-identified patent and that said Letters Patent is hereby corrected as shown below:

Title page, [76], "Inventor: James L. Karmin" should be --Inventor: James I. Karmin--

Signed and Sealed this

Twenty-first Day of March, 1995

*Attest:*

Bruce Lehman

BRUCE LEHMAN

*Attesting Officer*

*Commissioner of Patents and Trademarks*